US007871451B2

(12) United States Patent
Fujita et al.

(10) Patent No.: US 7,871,451 B2
(45) Date of Patent: Jan. 18, 2011

(54) MOISTURE SEPARATOR HEATER

(75) Inventors: Issaku Fujita, Takasago (JP); Jiro Kasahara, Takasago (JP); Jun Manabe, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 281 days.

(21) Appl. No.: 12/223,401

(22) PCT Filed: Jan. 30, 2007

(86) PCT No.: PCT/JP2007/051515

§ 371 (c)(1),
(2), (4) Date: Jul. 30, 2008

(87) PCT Pub. No.: WO2007/088858

PCT Pub. Date: Aug. 9, 2007

(65) Prior Publication Data

US 2009/0025391 A1 Jan. 29, 2009

(30) Foreign Application Priority Data

Jan. 31, 2006 (JP) ..... 2006-021637

(51) Int. Cl.
*B01D 51/00* (2006.01)

(52) U.S. Cl. ..... 55/418; 55/418.1; 55/419; 55/424; 55/DIG. 23

(58) Field of Classification Search ..... 55/320, 55/332, 418, 424, DIG. 23, 418.1, 419
See application file for complete search history.

(56) References Cited

U.S. PATENT DOCUMENTS 3,593,500 A * 7/1971 Ritland et al. ..... 55/319

FOREIGN PATENT DOCUMENTS

| | | |
|---|---|---|
| JP | 62-87704 | 4/1987 |
| JP | 2002-122303 | 4/2002 |
| JP | 2002-130609 | 5/2002 |

OTHER PUBLICATIONS

International Search Report mailed Apr. 17, 2007 for International Application No. PCT/JP2007/051515.
Japanese Office Action drafted Dec. 20, 2006 for Japanese Application No. 2006-021637 w/translation.

* cited by examiner

*Primary Examiner*—Robert A Hopkins
(74) *Attorney, Agent, or Firm*—Wenderoth, Lind & Ponack, L.L.P.

(57) ABSTRACT

A moisture separator heater includes a body, a manifold installed inside the body to supply moisture-containing steam to the interior thereof, slits formed on the manifold to allow a steam reserving portion positioned at the lower part of the body to eject steam, a separator for separating moisture from steam ejected from the slits, a steam collecting portion for collecting steam after separation of moisture by the separator, a heater for heating steam ascending inside the steam collecting portion, and a partition plate installed inside the steam collecting portion.

9 Claims, 9 Drawing Sheets

CROSS SECTION ALONG LINE I - I

CROSS SECTION ALONG LINE I - I

CROSS SECTION ALONG LINE II - II

MOISTURE SEPARATOR HEATER

TECHNICAL FIELD

The present invention relates to a structure of a moisture separator heater applicable in atomic power plants and others.

Priority is claimed on Japanese Patent Application No. 2006-021637, filed on Jan. 31, 2006, the content of which is in incorporated herein by reference.

BACKGROUND ART OF THE INVENTION

In an atomic power plant, there is installed a moisture separator heater between a high-pressure steam turbine and a low-pressure steam turbine. The moisture separator heater separates moisture in steam exhausted from the high-pressure steam turbine and also reheats the steam from which moisture is separated to give high-temperature steam, reducing the degree of moisture of steam at the inlet of the low-pressure steam turbine, thereby attaining an improved heat efficiency of turbine plants.

An explanation will be made for one example of a structure of a conventional moisture separator heater by referring to FIG. 12 to FIG. 14. FIG. 12 is a perspective view of a moisture separator heating apparatus, and FIG. 13 is a front sectional view of the apparatus. FIG. 14 is a sectional view taken along line III-III of the moisture separator heating apparatus given in FIG. 13. Steam F1 exhausted from a high-pressure steam turbine (not illustrated) flows from a steam inlet portion 22 into the interior of a cylindrical body 21 at which the moisture separator heater is mounted transversely. The steam F1 which has flown into the body 21 is divided into two flows and introduced into cylindrical manifolds 23 arranged horizontally in a symmetrical manner, when the body 21 is viewed in section from the longitudinal direction (refer to FIG. 14).

The manifolds 23 are also called a pipe-type manifold and installed so as to be parallel to each other substantially across the entire length of the moisture separator heater in the longitudinal direction. The manifold 23 is provided with a plurality of slits 24 across the entire length of the manifold 23, and steam F1 inside the manifolds 23 is ejected from the slits 24 toward a steam reserving portion 25 installed at the lower part of the interior of the body 21. Further, the steam F1 ejected to the steam reserving portion 25 is separated from moisture in the course of passage through a separator 26 installed downstream thereof and flows into a steam collecting portion 27. In a sectional view of the body 21, the manifold 23, the steam reserving portion 25 and the separator 26 are arranged by one each in a symmetrical manner, and installed across the entire length of the body 21 in the longitudinal direction. The steam F1 which has flown into the steam collecting portion 27 through the separator 26 ascends to the steam collecting portion 27, flows into a heater 28 and is heated again by high-pressure extraction steam F2, which is a part of high-pressure steam. The heater 28 is a multi-tubular heat exchanger made up of many heating tubes 30 formed in a U tube shape. The high-pressure extraction steam F2 flows inside the tube of the heater and the steam F1 which ascends from the steam collecting portion 27 flows outside the tube of the heater. The steam F1 exchanges heat with the high-pressure extraction steam F2 via the heating tubes 30 and is thereby heated. The steam F1 which has passed through the heater 28 flows out from a steam outlet portion 29 installed at the upper part of the body and is then fed to a low-pressure steam turbine (not illustrated). The high-pressure extraction steam F2 is changed to drain F3 and exhausted from the heater 28. A specific example of the thus-explained moisture separator heater is disclosed in Patent Document 1 given below.

Further, Patent Document 2 given below shows a specific example of slits installed on a pipe-type manifold of a moisture separator heater. The steam-ejecting slits are changed in length and width, depending on the position of the manifold in the longitudinal direction and designed so as to obtain a uniform steam flow distribution across the entire length of the body 21 of the steam reserving portion 25 in the longitudinal direction and also in such a manner that the flow velocity of steam ejected from the slits 24 will not exceed a limit value. Where the flow velocity of steam exceeds the limit value, erosion will easily take place on the inner wall of the body 21. The slits 24 are made smaller in length and width as they are further spaced away from the upstream end of the manifold 23 nearer to the steam inlet portion 22 to the downstream end thereof, that is, as they are further spaced away from the upstream end, by which the opening area is gradually decreased. Since the slits are arranged as described above, it is possible to make uniform the flow distribution of steam flowing into the separator and the flow velocity of steam across the entire length of the separator.

PATENT DOCUMENT 1: Japanese Unexamined Patent Application, First Publication No. 2002-130609

PATENT DOCUMENT 2: Japanese Unexamined Patent Application, First Publication No. 2002-122303

DETAILED DESCRIPTION OF THE INVENTION

Problems to be Solved by the Invention

However, in recent years, there has been demand for a miniaturized moisture separator heater due to a limited installation area of the moisture separator heater. Therefore, such a need has arisen for miniaturizing the pipe-type manifolds installed symmetrically inside the body. In order to miniaturize the pipe-type manifold, it is necessary to reduce the diameter of the manifold. As a result, an average flow velocity of steam flowing inside the manifold will be inevitably increased.

Where the average flow velocity of steam inside the manifold is increased, the volume of steam ejected from the slits is decreased in the upstream part nearer to the steam inlet portion 22 and increased in the downstream part. In other words, where an average flow velocity of steam inside the manifold is high, the effect of dynamic pressure is found inside the manifold, particularly in the vicinity of a slit nearer to the steam inlet portion, due to a high flow velocity of steam. Thereby, such a phenomenon is found that steam flowing around the outer periphery of the manifold near the slits is sucked into the manifold 23 through the slits 24 due to a siphoning effect.

On the occurrence of this phenomenon, a flow rate of the steam ejected to the steam reserving portion 25 through the slits 24 arranged downstream from the manifold 23 is increased in volume, as compared with the flow rate of the steam ejected to the steam reserving portion 25 through the slits 24 arranged upstream from the manifold 23. Therefore, when steam F1 ejected from the manifold 23 to the steam reserving portion 25 at the lower part of the body 21 flows into the separator 26, the concentration of steam is distributed unequally along the longitudinal direction of the manifold 23.

In this instance, for the sake of explanation, when the end portion of the manifold 23 nearer to the steam inlet portion 22 is given as an open end and the end portion on the opposite side thereof is given as a closed end, steam is higher in concentration in the vicinity of the closed end nearer to the terminal end of the manifold 23 and lower in the vicinity of the open end nearer to the steam inlet portion 22. Therefore, the steam F1 passing through the separator 26 is relatively abundant in the vicinity of the closed end of the manifold 23 and relatively scarce in the vicinity of the open end. In other words, the concentration of steam is distributed unequally along the longitudinal direction of the manifold 23 even at the steam collecting portion 27 downstream from the separator 26, and the concentration of steam is lower in the vicinity of the open end, while higher in the vicinity of the closed end. It is a normal state that the steam F1 which has flown into steam collecting portion 27 ascends toward the heater 28, as it is. However, where the concentration of steam is distributed unequally along the longitudinal direction of the steam collecting portion 27, some of the steam forms a horizontal flow from the closed end to the open end inside the steam collecting portion 27. Further, the horizontal flow of steam toward the open end flows reversely to the steam reserving portion 25 from the vicinity of the open end of the steam collecting portion 27 by way of the separator 26, some of which is sucked into the manifold 23 through the slits 24. Thereby, a steam circulating flow is partially formed. This phenomenon was analyzed, the results of which are shown in FIG. 15 and FIG. 16.

FIG. 15 shows flow distribution of steam at the cross section along line IV-IV of the moisture separator heating apparatus given in FIG. 14 (only one-sided distribution on the horizontal cross section in the longitudinal direction, with the border line given to the central line of the body in the longitudinal direction). FIG. 16 is an enlarged view of the A portion of the flow distribution given in FIG. 15. In FIG. 15 and FIG. 16, the flow direction of the steam is indicated by the arrows. At any place from the open end of the manifold to the closed end thereof, most of steam flows in the normal direction G1 from the steam reserving portion 25 to the steam collecting portion 27 by way of the separator 26 (the flow from below to above on the space at the position of the separator given in FIG. 15). However, as shown in FIG. 16, steam flows in the reverse direction G2, or from the steam collecting portion 27 to the steam reserving portion 25, around the open end of the manifold. This reversely-flowing phenomenon reduces the capacity of the separator, thus affecting the performance of the moisture separator heater.

Further, when the velocity of steam ejected from slits of the manifold to the steam reserving portion is distributed unequally from the open end to the closed end, the velocity of steam ejected from the slits may exceed a limit value, depending on the place, thus resulting in a case where erosion takes place on the inner wall of the body.

The present invention has been made to solve the above problems, an object of which is to prevent steam from flowing in reverse after passage through the separator to improve the capacity of the separator, thereby improving the efficiency of the moisture separator heater as a whole, and another object of which is to prevent erosion from taking place on the inner wall of the body.

Means for Solving the Problems

The moisture separator heating apparatus of the present invention is provided with a body, a manifold installed inside the body to supply moisture-containing steam to the interior thereof, slits formed on the manifold for allowing a steam reserving portion positioned at the lower part of the body to eject steam, a separator for separating moisture from steam ejected from the slits, a steam collecting portion for collecting steam after separation of moisture by the separator, a heater for heating steam ascending inside the steam collecting portion, and a partition plate installed inside the steam collecting portion.

According to the moisture separator heating apparatus of the present invention, such a phenomenon that steam flows in reverse after passage through the separator can be prevented, thus making it possible to improve the capacity of the separator and also increase the efficiency of the moisture separator heater as a whole.

The manifold may be provided with a slit which is one of the slits arranged closer to a closed end than the partition plate and which is positioned nearest to the partition plate among the slits arranged at the closed end side of the manifold, and second slit which is one of the slits arranged closer to an open end than the partition plate and which is positioned nearest to the partition plate among the slits arranged at the open end side of the manifold. In this instance, the first slit may have greater opening area than the second slit. Further, the slits formed on the manifold may be installed in such a manner that the opening area of each of slit are gradually decreased from the first slit towards subsequent slits at the closed end of the manifold, and the opening area of each of slit are gradually increases from the second slit toward subsequent slits at the open end of the manifold.

According to the moisture separator heating apparatus of the present invention, the flow velocity of steam ejected from the steam reserving portion can be kept within a limit value, thus making it possible to effectively prevent erosion of the inner wall of the body from taking place.

In the moisture separator heating apparatus of the present invention, the partition plate may be installed in a range up to one-fifth of the entire length of the steam collecting portion from the open end in the longitudinal direction.

According to the moisture separator heating apparatus of the present invention, the partition plate is positioned at a site corresponding to a site at which such a phenomenon takes place that steam inside the steam reserving portion is sucked into the manifold through the slits. Therefore, the phenomenon of steam flowing in reverse at the steam collecting portion can be prevented more securely to improve the performance of the separator.

ADVANTAGEOUS EFFECTS OF THE INVENTION

The present invention is able to prevent the phenomenon of steam flowing in reverse after passage through the separator, thereby improving the capacity of the separator. It is therefore possible to improve the efficiency of the moisture separator heater as a whole and also prevent erosion from taking place on the inner wall of the body.

DESCRIPTION OF THE REFERENCE SYMBOLS

1 MOISTURE SEPARATOR HEATER
2, 21 BODY
2A INNER WALL OF THE BODY
3, 22 STEAM INLET PORTION
4 END PLATE
5, 23 MANIFOLD
6, 6A, 6B, 24 SLIT
7, 25 STEAM RESERVING PORTION
8, 26 SEPARATOR
9, 27 STEAM COLLECTING PORTION
10, 28 HEATER
11, 30 HEATING TUBE
12, 29 STEAM OUTLET PORTION
13 PARTITION PLATE
14 OPEN END
15 CLOSED END
X POINT STEAM POINT OF COLLISION ON THE INNER WALL OF THE BODY
Y POINT POSITION OF PARTITION PLATE
F1 STEAM
F2 HIGH-PRESSURE EXTRACTION STEAM
F3 DRAIN

DETAILED DESCRIPTION OF THE INVENTION

Figure 1:
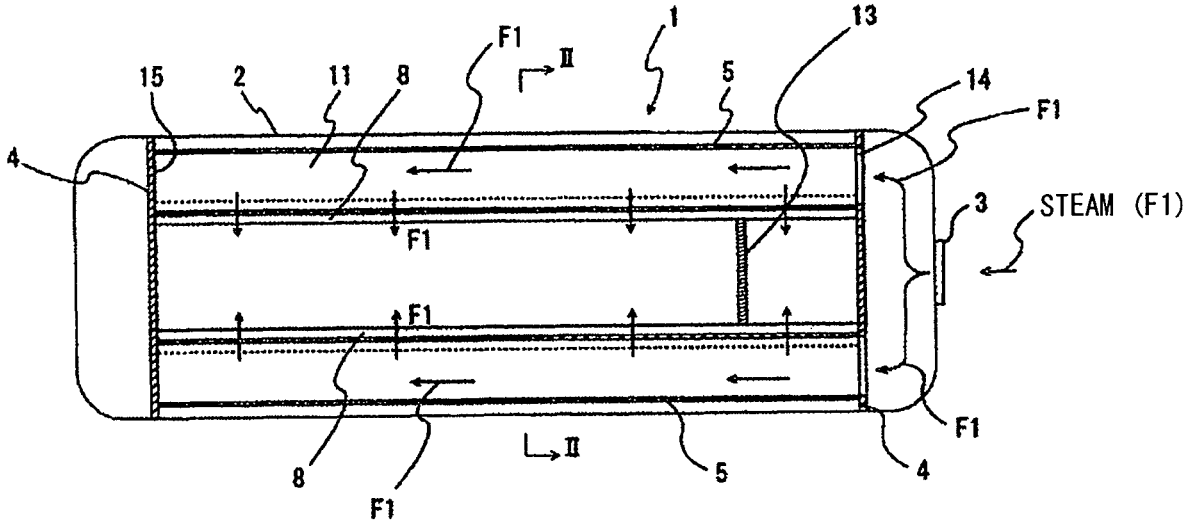
FIG. 1 is a drawing showing Embodiment 1 of the moisture separator heater of the present invention, or a plan sectional view of the moisture separator heater (a sectional view taken along line I-I given in FIG. 2).
Figure 2:
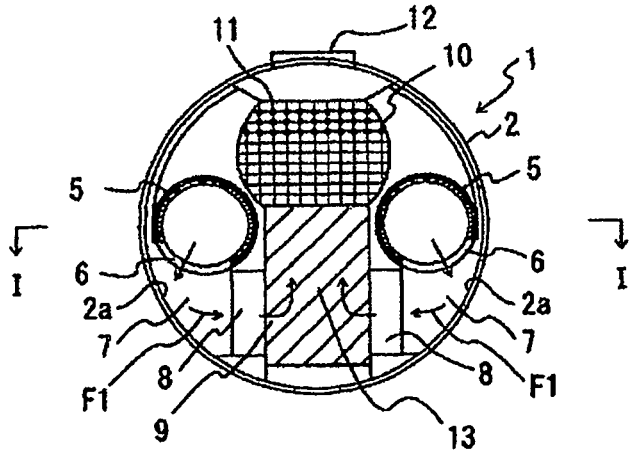
FIG. 2 is a drawing showing Embodiment 1 of the moisture separator heater of the present invention, or a sectional view of the moisture separator heater along line II-II given in FIG. 1.
Figure 3:
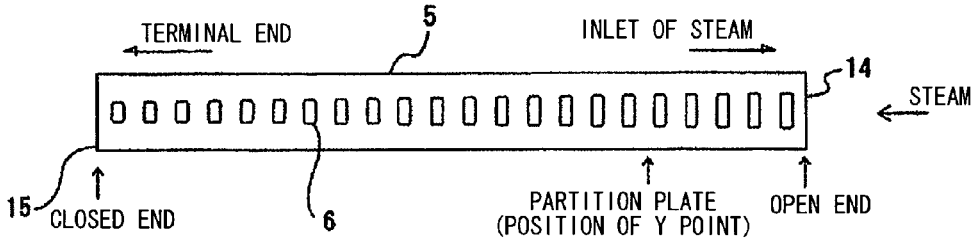
FIG. 3 is a drawing showing Embodiment 1 of the moisture separator heater of the present invention, or a side view of the manifold equipped at the moisture separator heater.

Hereinafter, an explanation will be made for Embodiment 1 of the present invention by referring to the drawings. First, a structure of the moisture separator heater of the present invention is shown in FIG. 1 to FIG. 7. FIG. 1 is a sectional view (a plan sectional view of the moisture separator heating apparatus) taken along line I-I of the moisture separator heating apparatus given in FIG. 2. FIG. 2 is a sectional view taken along line II-II of the moisture separator heating apparatus given in FIG. 1. FIG. 3 shows a manifold of the present invention. FIG. 4 to FIG. 7 show the results of flow analysis of steam flowing around the separator of the present invention.

An explanation will be made for a structure of the moisture separator heater by referring to FIG. 1 and FIG. 2. A moisture separator heater 1 is a transversely-mounted cylindrical pressure vessel. In a sectional view of a body 2 (refer to FIG. 2), in which a steam collecting portion 9 and a heater 10 are arranged at the center of a body 2 so as to be connected in a vertical direction. Manifolds 5, a steam reserving portion 7 and a separator 8 are arranged respectively across the steam collecting portion 9 and the heater 10 in a symmetrical manner. Further, an end plate 4 is installed respectively at both ends inside the body 2 in the longitudinal direction. The end plate 4 which is nearer to a steam inlet portion 3 partitions the steam F1 supplied from a high-pressure turbine (not illustrated) to the moisture separator heater 1 through the steam inlet portion 3 from the steam F1 flowing through the steam reserving portion 7 and a steam collecting portion 9. Each of the manifolds 5 is formed in a cylindrical shape and arranged along the longitudinal direction of the body 2 between the end plates 4 arranged at both ends inside the body 2 in the longitudinal direction. Each end of the manifold 5 is fixed at one end to one of the end plates 4, while fixed at the other end to the other of the end plates 4. Further, one end nearer to the steam inlet portion 3 of the manifold 5 constitutes an open end 14 having an opening capable of accepting the steam F1 from the steam inlet portion 3, and the other end of the manifold 5 constitutes a closed end 15 closed by contacting the end plate 4. Still further, a plurality of slits 6 are formed at the lower part on the outer periphery wall face of the manifold 5 across the entire length of the body 2 in the longitudinal direction The steam F1 which has flown into the manifold 5 is ejected through the slits 6 to the steam reserving portion 7 installed at the lower part of the interior of the body 2. Further, a separator 8 is arranged between the steam reserving portion 7 and the steam collecting portion 9 across the entire length of the body 2 in the longitudinal direction. The separator 8 removes moisture contained in the steam F1 during the passage of the steam F1. The separator 8 may adopt, for example, a corrugated panel-type separator and a mesh panel-type separator. The steam collecting portion 9 acts to merge the steam F1 which has passed through the separator 8 arranged symmetrically and guide the thus merged steam to the heater 10 arranged at the upper part.

Further, a partition plate 13 for preventing the reverse flow of steam is disposed at the steam collecting portion 9. As shown in FIG. 1, the partition plate 13 is installed only at one site in a region nearer to the open end 14 of the steam collecting portion 9 arranged along the longitudinal direction of the body 2. When the moisture separator heater is viewed in section (a part shown by the hatching in FIG. 2) (refer to FIG. 2), it is installed so as to cover an entire face of the cross sectional portion of the steam collecting portion 9. The partition plate 13 is preferably installed in a region within one-fifth of the entire length of the steam collecting portion 9 between the open end 14 and the end plate 4 along the longitudinal direction. The thus installed position corresponds to a region at which a phenomenon of the steam F1 inside the steam reserving portion 7 being sucked into the manifold 5 through the slits 6 takes place in a maximum load operation. Thereby, it is possible to eliminate the phenomenon of the steam F1 flowing in reverse from the steam collecting portion 9 to the steam reserving portion 7. In the heater 10, the steam F1 which has ascended from the steam collecting portion 9 is heated by high-pressure extraction steam F2 via the heating tube 11. A steam outlet portion 12 is installed at the upper part of the heater 10 or at the center of the upper face of the body 2 and the steam F1 after being heated is sent from the steam outlet portion 12 to a low pressure turbine (not illustrated).

Next, an explanation will be made for a flow of steam, that is, the flow of the steam F1 introduced into the moisture separator heater and exhausted from the moisture separator heater, by referring to FIG. 1 and FIG. 2. The steam F1 exhausted from the high-pressure steam turbine (not illustrated) is introduced from the steam inlet portion 3 into the moisture separator heater 1. The steam F1 which has flown inside from the steam inlet portion 3 is divided into two flows, running into the manifolds 5 arranged horizontally in a symmetrical manner. Further, the steam F1 which has flown into the manifold 5 is ejected through the slits 6 to the steam reserving portion 7. Then, the steam F1 which has ejected the steam reserving portion 7 collides against the inner wall 2*a* of the body to change direction, thereby flowing into the separator 8 installed in the downstream part thereof. During the passage through the separator 8, moisture contained in the steam F1 is separated and the moisture-separated steam F1 merges at the steam collecting portion 9. The thus merged steam ascends to the steam collecting portion 9 and flows into the heater 10. At the heater 10, the high-pressure turbine extraction steam F2 is partially introduced into the heating tube 11, and the steam F1 ascending from the steam collecting portion 9 flows outside the heating tube 11. The steam F1 exchanges heat with the high-pressure extraction steam F2 via many heating tubes 11 disposed inside the heater 10 and is heated again. The steam F1 after being heated is exhausted from the steam outlet portion 12 and sent to the low pressure turbine (not illustrated). As with conventional techniques, the high-pressure extraction steam F2 after being heated is exhausted from the moisture separator heater as drain F3.

Next, an explanation will be made for the manifold 5 by referring to FIG. 3. The manifold 5 is a pipe-type manifold, and two manifolds 5 are installed symmetrically at the body 2, when the body is viewed in section. Each of the manifolds 5 is fixed at one end to one of the end plates 4 and fixed at the other end to the other of the end plates 4. Further, one end nearer to the steam inlet portion 3 of the manifold 5 constitutes an open end 14 having an opening which can accept the steam F1 from the steam inlet portion 3, while the other end of the manifold 5 constitutes a closed end 15 closed by contacting the end plate 4. Still further, a plurality of slits 6 are formed at the lower part of the outer-periphery wall face of the manifold across the entire length of the body 2 in the longitudinal direction. A plurality of the slits 6 are arranged from the open end 14 to the closed end 15 in such a manner that the central position of each of the slits is in alignment with the central axis of the manifold. Further, the shape of each of the slits 6 is not limited to a rectangular shape but may include a circular shape and an oval shape. Further, a plurality of the slits 6 are formed in such a manner that each of the slits 6 is gradually decreased in opening area from the open end 14 to the closed end 15. A ratio of the opening area of the slit nearest the open end 14 to that of the slit nearest the closed end 15 is selected so as to be approximately one fourth. It is noted that the number of slits 6 given in FIG. 3 is indicated only as an example, and the present invention is not limited to the above-described number of slits.

As described above, a reason for changing the opening area depending on the position of the slit from the open end 14 is that the flow rate of steam ejected from each of the slits 6 formed across the entire length of the manifold 5 is made uniform as much as possible so that the steam can flow into the separator 8 at a constant velocity. As described above, the steam which has flown into the manifold 5 is greater in flow velocity in the vicinity of the slit, in particular nearer the steam inlet portion inside the manifold 5, and influenced by a dynamic pressure, thereby causing a phenomenon that the steam flowing at the outer periphery of the manifold 5 in the vicinity of slits is sucked into the manifold 5 through the slits 6 due to a siphoning effect.

Because of this phenomenon, the flow rate of the steam ejected to the steam reserving portion 7 through the slits 6 arranged downstream from the manifold 5 is increased in volume, as compared with the flow rate of the steam ejected at the steam reserving portion 7 through the slits 6 arranged upstream from the manifold 5. Therefore, when the steam F1 ejected from the manifold 5 to the steam reserving portion 7 at the lower part of the body 2 flows into the separator 8, the concentration of steam is distributed unequally along the longitudinal direction of the manifold 5. As described above, when there is greater variance in the velocity of steam flowing into the separator 8, moisture is not sufficiently removed by the separator 8 to result in a decreased efficiency of the moisture separator heater as a whole. Therefore, in order to ensure a uniform flow distribution of steam as much as possible and also to make constant the velocity of steam flowing into the separator, it is important to increase the opening area of the slits 6 at the open end and decrease that of the slits 6 at the closed end, thereby selecting an appropriate opening area. Further, it is desirable that each of the slits 6 is arranged at the same pitch. However, the slits 6 at the closed end 15 which are decreased in opening area may be arranged at a shorter pitch than the slits 6 at the open end which are increased in opening area. Still further, it is desirable that the slits 6 are arranged in such a manner that the opening area thereof is gradually decreased from the open end 14 to the closed end 15. However, the slits 6 nearer to the closed end 15 may be arranged so that a plurality of adjacent slits 6 are equal in opening area.

In the present invention, in order to prevent a phenomenon of the steam F1 merged at the steam collecting portion 9 flowing in reverse to the steam reserving portion 7 via the separator 8, the partition plate 13 is installed inside the steam collecting portion 9. However, only an installation of the partition plate 13 may result in a case where steam is ejected from a slit and the flow velocity may exceed a limit value, depending on operational conditions.

Figure 4:
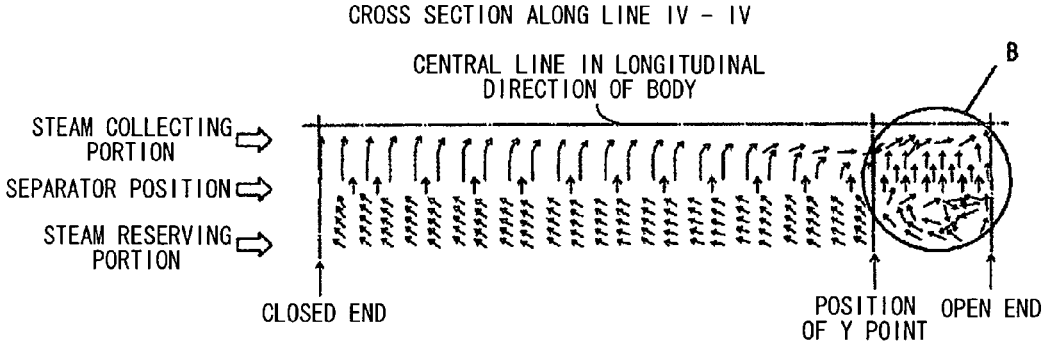
FIG. 4 is a distribution chart of steam flow which shows the results of flow analysis in Embodiment 1 of the moisture separator heater of the present invention.
Figure 5:
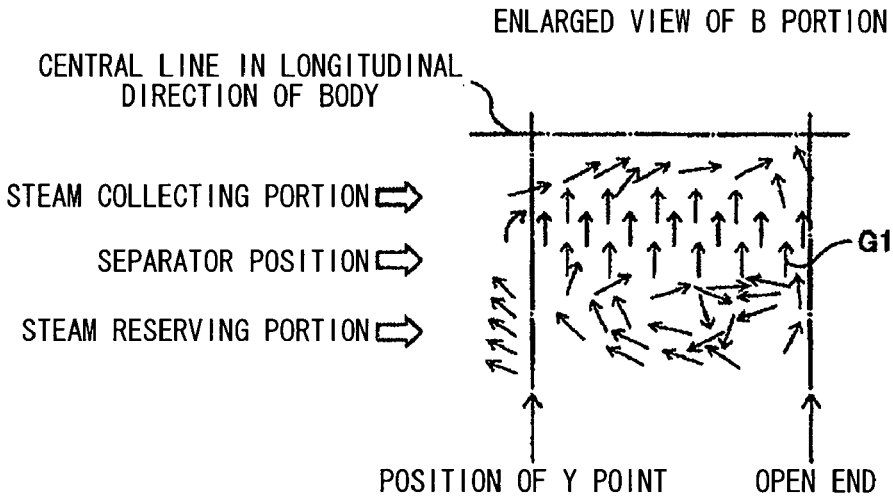
FIG. 5 is a distribution chart of steam flow which shows the results of flow analysis in Embodiment 1 of the moisture separator heater of the present invention, or an enlarged view of the B portion given in FIG. 4.
Figure 14:
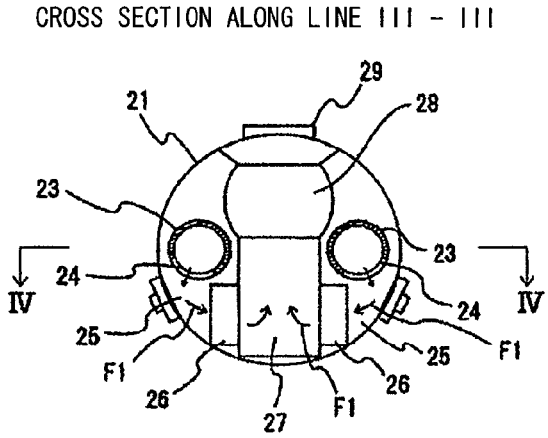
FIG. 14 is a sectional view taken along line III-III of the conventional moisture separator heater given in FIG. 13.
Figure 15:
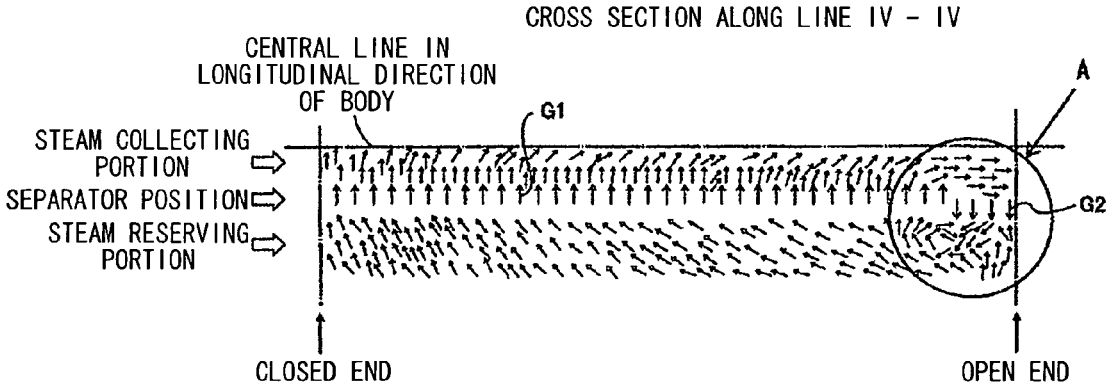
FIG. 15 is a distribution chart of steam flow showing the results of flow analysis in the conventional moisture separator heater.
Figure 16:
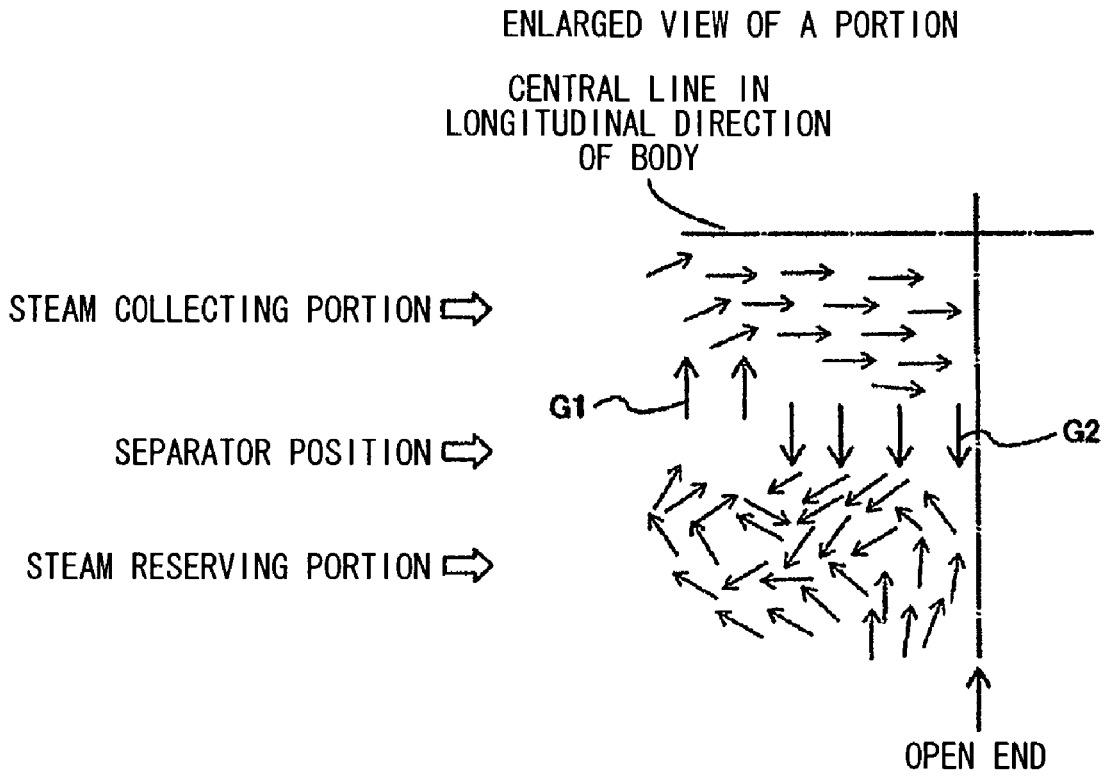
FIG. 16 is a distribution diagram of steam flow which shows the results of flow analysis in the conventional moisture separator heater, or an enlarged view of the A portion given in FIG. 15.

FIG. 4 to FIG. 7 show the results of flow analysis obtained in a case where the partition plate 13 is merely installed at the steam collecting portion 9. FIG. 4 shows the flow distribution at the cross section taken along line IV-IV in FIG. 14, as described above in FIG. 15. FIG. 5 is an enlarged view showing the B portion in FIG. 4. Further, in FIG. 6, the lateral axis indicates a distance of the manifold 5 from the open end 14 and the longitudinal axis indicates the normal velocity of steam ejected from the slits 6 depending on the distance. Specifically, it indicates the normal velocity of steam colliding against X point on the inner wall 2*a* of the body given in FIG. 7. Further, Y point given in FIG. 4 indicates a position at which the partition plate 13 is installed. As shown in FIG. 4 and FIG. 5, all flows indicate a normal flow direction across the entire length of the manifold 5 from the open end 14 to the closed end 15 in the longitudinal direction in view of the flow distribution of steam in front and in back of the separator 8, and there is found no phenomenon of steam flowing reversely from the steam collecting portion 9 to the steam reserving portion 7. In other words, as shown in an enlarged view of the B portion in FIG. 5, in front and in back of the separator 8, steam flows along the appropriate direction G1 indicated by the arrows from the steam reserving portion 7 to the steam collecting portion 9. More specifically, it is apparent that the partition plate 13 is installed, thereby eliminating a phenomenon at which steam flows in reverse.

Figure 6:
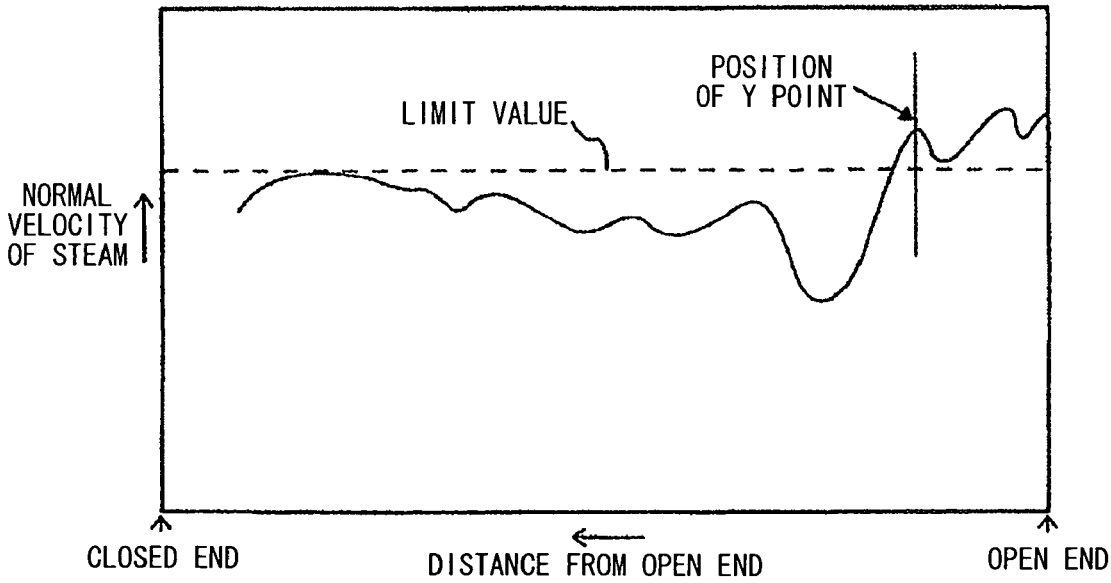
FIG. 6 is a graph showing the results of flow analysis in Embodiment 1 of the moisture separator heater of the present invention, or a graph showing a relationship between a distance from the open end of the manifold and a normal velocity of steam ejected from slits depending on the distance.
Figure 7:
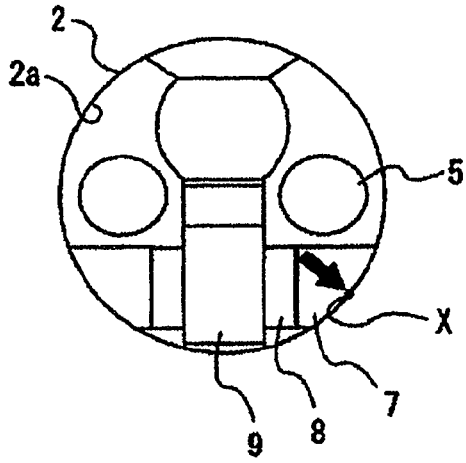
FIG. 7 is a sectional view of the moisture separator heater showing a point of measuring the normal velocity of steam.

However, as shown in FIG. 6, there is found a region generated between the open end and the Y point where the normal velocity of steam may exceed a limit value depending on loads of the moisture separator heater. Erosion may take place in this region, which must be improved.

Figure 8:
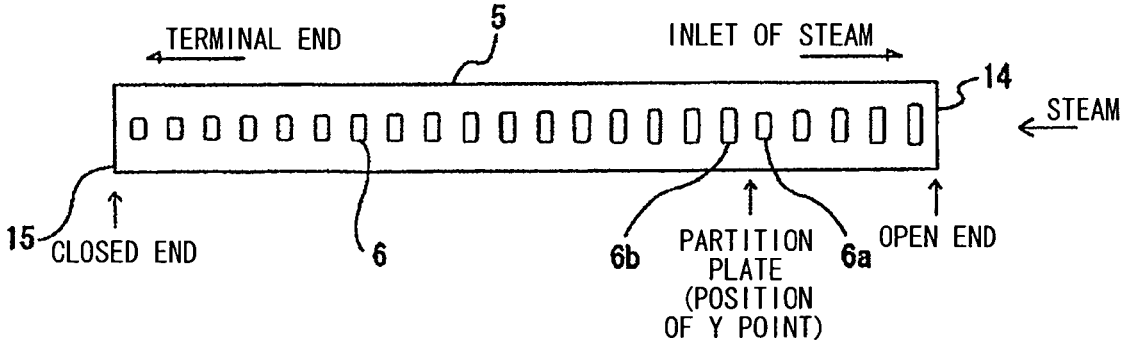
FIG. 8 is a drawing showing Embodiment 2 of the moisture separator heater of the present invention, or a side view of the manifold equipped at the moisture separator heater.

Hereinafter, an explanation will be made for Embodiment 2 based on improved measures for the erosion. The present invention has features to adjust an opening area of slits as follows, in addition to the above-installed partition plate 13. A specific adjustment method will be explained hereinafter by referring to FIG. 8. As described above, in order to attain a uniform flow rate distribution of steam ejected along the longitudinal direction of the body 2, in principle, the opening area of each of the slits is gradually decreased in order from the open end 14 to the closed end 15. However, since the normal velocity of steam from the open end 14 to the Y point is kept within a limit value, it is necessary to further decrease the opening area of the slits positioned at the open end from the Y point. On the other hand, in order to attain a constant flow rate of steam ejected from each slit of the manifold 5, a total opening area of the slits 6 must be kept equal to an area of the slits before installation of the partition plate. Therefore, the opening area of each of the slits 6 from the open end 14 to the Y point is decreased at a constant ratio (for example, decrease in 30%) so as to be decreased as the slits 6 move nearer to the Y point, and of slits from the Y point to the closed end 15, the same number of slits as those at which the opening area is decreased are increased in opening area at a constant ratio, thereby keeping the total area of the slits unchanged. In other words, each of the slits from the open end 14 to the Y point is gradually decreased in opening area as it is spaced further away from the open end 14, and also each slit is further decreased in opening area than the area before installation of the partition plate 13.

Further, regarding each of the slits arranged from the Y point to the closed end 15, the same number of slits as the slits 6 positioned between the Y point to the open end 14 including a starting slit (a slit 6*b* nearest to the partition plate at the side of the closed end) positioned nearest to the Y point at the downstream side of the Y point (a direction toward the closed end) are increased in opening area than the area before installation of the partition plate 13. In this instance, a decrease in opening area of the slits 6 positioned at the upstream side from the Y point is supplemented by an increase in opening area of the same number of the slits 6 positioned at the downstream side from the Y point, thereby keeping the total opening area unchanged. However, in order to ensure that the normal velocity of steam is kept within a limit value, it is important to set the opening area of the slit 6*b* nearest to the partition plate at the closed end side of the manifold greater than that of the slit nearest to the Y point at the upstream side of the Y point (the slit 6*a* nearest to the partition plate at the open end side of the manifold). Further, each of the slits 6 arranged up to the closed end 15 downstream from the slit at which the opening area is adjusted (a direction toward the closed end) has the same opening area as that of where no partition plate 13 is installed. In other words, with the partition plate 13 (Y point) given as a border, the slits 6 are gradually increased in opening area from the slit 6*a* nearest to the partition plate at the open end side of the manifold to the slits at the open end 14, while the slits 6 are gradually decreased in opening area from the slit 6*b* nearest to the partition plate at the closed end side of the manifold to the slits at the closed end 15.

In order to prevent the normal velocity of steam exceeding a limit value, the slits 6 are adjusted for the opening area by decreasing an area of the slits 6 positioned at the open end 14 from the Y point so that the thus decreased opening area can be supplemented by an increase in area of the slits 6 positioned at the closed end 15 from the Y point. However, each of the slits 6 may be uniformly increased or decreased in area. Specifically, the slits 6 positioned at the open end 14 from the Y point may be uniformly decreased in area by the same extent, while the slits 6 positioned at the closed end 15 from the Y point may be uniformly increased in area by the same extent in a range not exceeding the normal velocity of steam, by which the slits 6 are kept unchanged in opening area as a whole. In this instance as well, the slits 6 are gradually increased in opening area from the slit 6*a* nearest to the partition plate at the side of the open end 14 to slits 6 at the open end 14, while the slits 6 are gradually decreased in opening area from the slit 6*b* nearest to the partition plate at the side of the closed end 15 to slits 6 at the closed end 15. It is noted that, similarly, the opening area of the slit 6*b* nearest to the partition plate at the side of the closed end 15 is made greater than that of the slit 6*a* nearest to the partition plate at the side of the open end 14.

Figure 9:
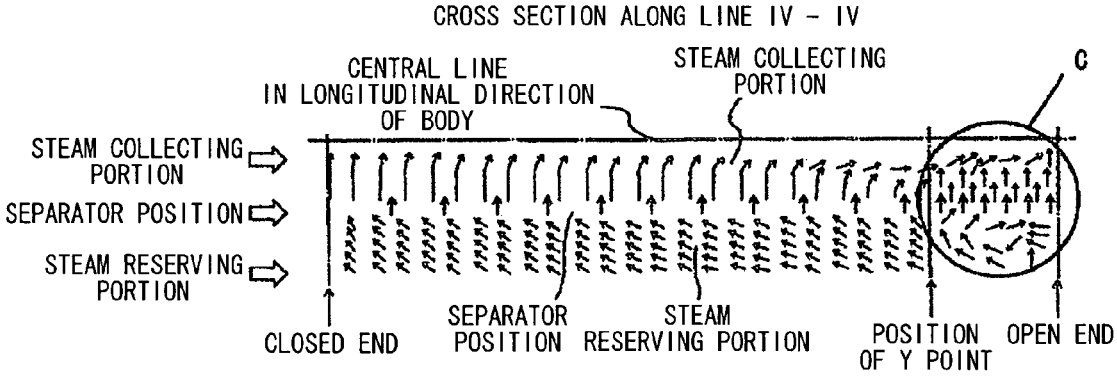
FIG. 9 is a distribution chart of steam which shows the results of flow analysis of Embodiment 2 of the moisture separator heater of the present invention.
Figure 10:
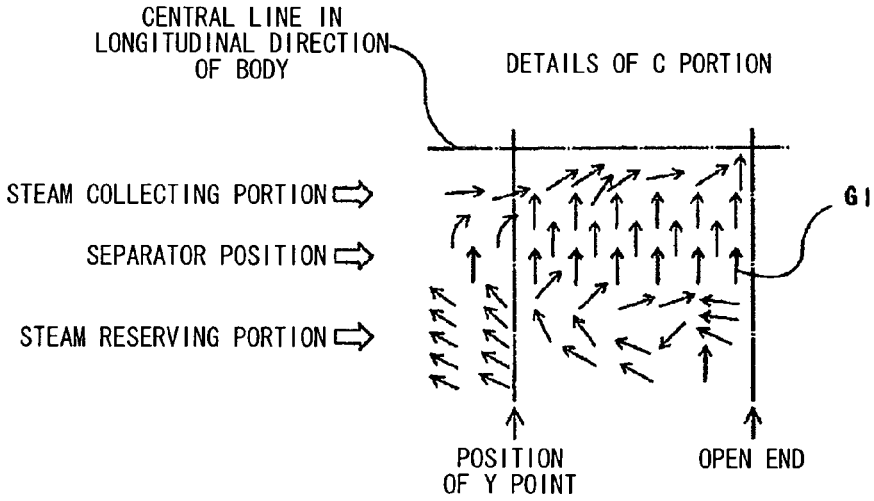
FIG. 10 is a distribution chart of steam flow which shows the results of flow analysis in Embodiment 2 of the moisture separator heater of the present invention, or an enlarged view of the C portion given in FIG. 9.
Figure 11:
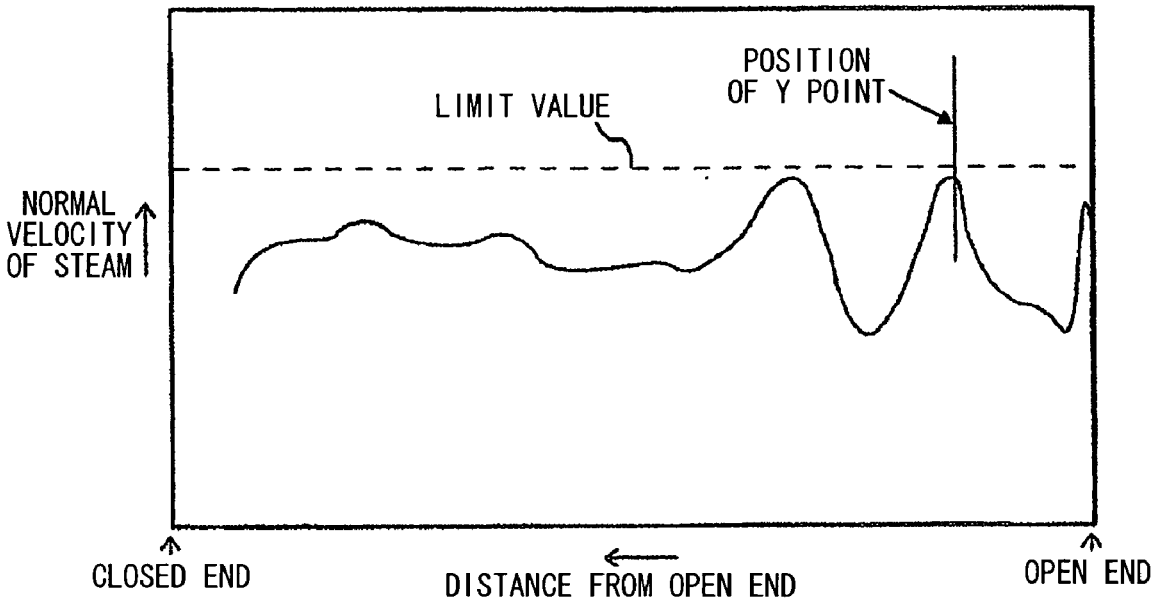
FIG. 11 is a graph showing the results of flow analysis in Embodiment 2 of the moisture separator heater of the present invention, or a graph showing a relationship between the distance from the open end of the manifold and the normal velocity of steam ejected from the slits depending on the distance.
Figure 12:
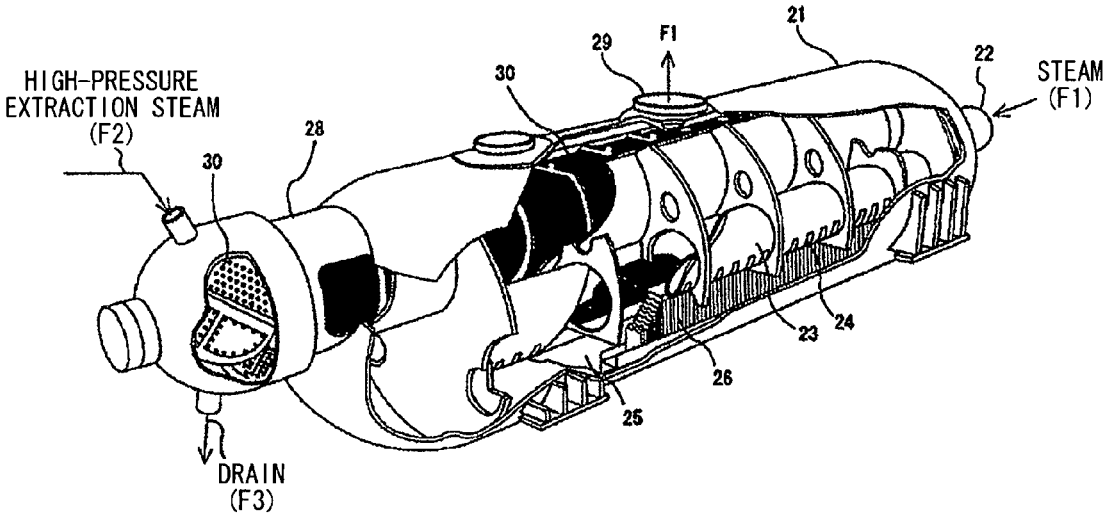
FIG. 12 is a perspective view showing a conventional moisture separator heater.
Figure 13:
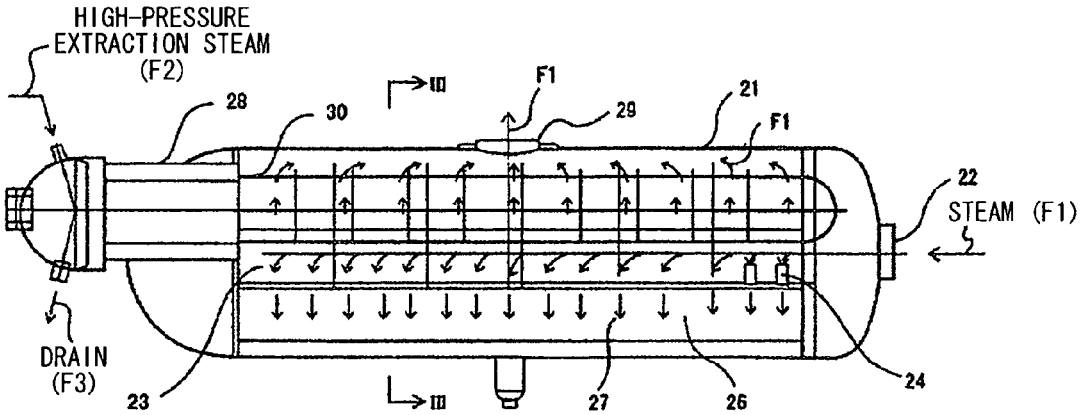
FIG. 13 is a side sectional view of the conventional moisture separator heater.

FIG. 9 to FIG. 11 show the results of flow analysis obtained when the manifold 5 after the slits 6 adjusted for arrangement as described above is combined with the partition plate 13 installed at the steam collecting portion 9. FIG. 9 shows a flow distribution of steam on the cross section taken along line IV-IV given in FIG. 14, as described above in FIG. 4, and FIG. 10 is an enlarged view showing the C portion given in FIG. 9. Further, in FIG. 11, the lateral axis indicates the distance of the manifold 5 from the open end 14 and the longitudinal axis indicates the velocity of steam ejected from the slits 6 in relation to the lateral axis (that is, a normal velocity of steam). As shown in FIG. 9 and FIG. 10, as compared with only an installation of the partition plate 13, there is found no phenomenon of steam reversely flowing from the steam collecting portion 9 to the steam reserving portion 7 across the entire length of the manifold 5 from the open end 14 to the closed end 15 in the longitudinal direction, similar to the situation as only an installation of the partition plate 13. However, as shown in FIG. 11, the slits 6 are adjusted for the opening area, thereby obtaining a remarkable improvement in distribution of normal velocity of steam colliding against the inner wall 2*a* of the body between the open end 14 and the Y point, as compared with only an installation of the partition plate 13, and the distribution is made relatively uniform across the entire length of the body 2 in the longitudinal direction. As a result, the normal velocity of steam can be kept below a limit value to effectively prevent erosion from taking place on the inner wall of the body.

An explanation has been so far made for preferred embodiments of the present invention, to which the present invention shall not be, however, limited. The present invention may be subjected to additions, omissions, replacements and other modifications within a scope not departing from the spirit of the present invention. The present invention shall not be limited to the above description but will be limited only by the scope of the attached claims.

INDUSTRIAL APPLICABILITY

The present invention relates to a moisture separator heater, which is provided with a body, a manifold installed inside the body to supply moisture-containing steam to the interior thereof, slits formed on the manifold to allow a steam reserving portion positioned at the lower part of the body to eject steam, a separator for separating moisture from steam ejected from the slits, a steam collecting portion for collecting steam after separation of moisture by the separator, a heater for heating steam ascending inside the steam collecting portion, and a partition plate installed inside the steam collecting portion. According to the present invention, a phenomenon in which steam flows in reverse after passage through the separator is prevented to improve the capacity of the separator, thereby making it possible to improve the efficiency of the moisture separator heater as a whole and also prevent erosion from taking place on the inner wall of the body.

The invention claimed is:

1. A moisture separator heater, comprising:

a body;

a steam reserving portion positioned at a lower part of the body;

a manifold installed inside the body to supply moisture-containing steam to an interior of the body, wherein slits are formed on the manifold to allow the steam to flow from the manifold to the steam reserving portion, a separator for separating moisture from steam ejected from the slits;

a steam collecting portion for collecting steam after separation of moisture by the separator;

a heater for heating steam ascending inside the steam collecting portion; and a partition plate installed inside the steam collecting portion and covering an entire cross section of the steam collecting portion.

2. The moisture separator heater according to claim 1, wherein the manifold includes an open end into which the steam flows and a closed end opposite to the open end, wherein the slits in the manifold include a first slit and a second slit, the first slit being arranged closer to the closed end of the manifold than the partition plate and being positioned nearest to the partition plate among the slits arranged at the closed end side of the manifold, and the second slit being arranged closer to the open end than the partition plate and being positioned nearest to the partition plate among the slits arranged at the open end side of the manifold, wherein the first slit has greater opening area than the second slit, and wherein the slits are configured such that an opening area of the slits gradually decreases from the first slit toward the closed end of the manifold, and the opening area of the slits gradually increases from the second slit toward the open end of the manifold.

3. The moisture separator heater according to claim 1, wherein the manifold includes an open end into which the steam flows and a closed end opposite to the open end, and wherein the partition plate is positioned within one-fifth of an entire length of the steam collecting portion from the open end of the manifold in a longitudinal direction of the steam collecting portion.

4. The moisture separator heater according to claim 2, wherein the partition plate is positioned within one-fifth of the entire length of the steam collecting portion from the open end of the manifold in a longitudinal direction of the steam collecting portion.

5. The moisture separator heater according to claim 1, wherein the partition plate seals the steam collecting portion such that steam is prevented from flowing from one side of the partition plate to the other side of the partition plate in the steam collecting portion.

6. The moisture separator heater according to claim 5, wherein the manifold includes an open end into which the steam flows and a closed end opposite to the open end, wherein the slits in the manifold include a first slit and a second slit, the first slit being arranged closer to the closed end of the manifold than the partition plate and being positioned nearest to the partition plate among the slits arranged at the closed end side of the manifold, and the second slit being arranged closer to the open end than the partition plate and being positioned nearest to the partition plate among the slits arranged at the open end side of the manifold, wherein the first slit has greater opening area than the second slit, and wherein the slits are configured such that an opening area of the slits gradually decreases from the first slit toward the closed end of the manifold, and the opening area of the slits gradually increases from the second slit toward the open end of the manifold such that the flow rate of steam from the manifold into the steam reserving portion is uniform in a longitudinal direction of the manifold.

7. The moisture separator heater according to claim 6, wherein the partition plate is positioned within one-fifth of the entire length of the steam collecting portion from the open end of the manifold in a longitudinal direction of the steam collecting portion.

8. The moisture separator heater according to claim 1, wherein the manifold includes an open end into which the steam flows and a closed end opposite to the open end, wherein the slits in the manifold include a first slit and a second slit, the first slit being arranged closer to the closed end of the manifold than the partition plate and being positioned nearest to the partition plate among the slits arranged at the closed end side of the manifold, and the second slit being arranged closer to the open end than the partition plate and being positioned nearest to the partition plate among the slits arranged at the open end side of the manifold, wherein the first slit has greater opening area than the second slit, and wherein the slits are configured such that an opening area of the slits gradually decreases from the first slit toward the closed end of the manifold, and the opening area of the slits gradually increases from the second slit toward the open end of the manifold such that the flow rate of steam from the manifold into the steam reserving portion is uniform in a longitudinal direction of the manifold.

9. The moisture separator heater according to claim 8, wherein the partition plate is positioned within one-fifth of the entire length of the steam collecting portion from the open end of the manifold in a longitudinal direction of the steam collecting portion.

* * * * *